United States Patent [19]

Short et al.

[11] 4,076,871

[45] Feb. 28, 1978

[54] METHOD OF IMPREGNATING WOOD WITH BORIC ACID

[75] Inventors: Buddy M. Short, Ovett; Jerry W. Rayfield, Laurel, both of Mich.

[73] Assignee: Masonite Corporation, Chicago, Ill.

[21] Appl. No.: 738,278

[22] Filed: Nov. 2, 1976

[51] Int. Cl.[2] ..... B05D 3/02; B05D 1/18

[52] U.S. Cl. ..... 427/397; 106/15 FP; 252/8.1; 427/440; 428/921

[58] Field of Search ..... 162/159; 106/15 FP, 106/286, 308 B; 51/309; 260/2.5 AS, 2.5 FP; 427/377, 440, 397; 252/8.1; 428/921

[56] References Cited

U.S. PATENT DOCUMENTS

| | | | |
|---|---|---|---|
| 1,804,633 | 5/1931 | McKee | 427/397 |
| 1,907,711 | 5/1933 | Becher | 162/159 X |
| 3,285,774 | 11/1966 | Goldstein et al. | 427/397 X |
| 3,367,863 | 2/1968 | Cooper et al. | 252/2 |
| 3,438,847 | 4/1969 | Chase | 427/397 X |
| 3,895,997 | 7/1975 | Haywood | 162/159 X |
| 3,900,327 | 8/1975 | Miller | 162/159 X |

*Primary Examiner*—Michael R. Lusignan
*Attorney, Agent, or Firm*—Mason, Kolehmainen, Rathburn & Wyss

[57] ABSTRACT

This invention relates to a method of impregnating wood with boric acid or boron oxide. In particular it relates to a method of introducing boric acid into wood products by application thereto of boric acid esters of alcohols and thereafter hydrolyzing the esters to deposit boric acid within the wood product.

6 Claims, No Drawings

METHOD OF IMPREGNATING WOOD WITH BORIC ACID

BACKGROUND OF THE INVENTION

It has been well known that boric acid or boron oxide serves as a flame-proofing and fire-retardant agent for wood products. For instance, the Videen U.S. Pat. No. 3,202,570 describes procedures for introducing hydrated borate compounds in the form of fine particles throughout wood for the purpose of fire retardation. Similarly, the Quinn U.S. Pat. No. 2,030,653 describes the fire-proofing of fiberboard and similar wood products by depositing boric acid or ammonium borate therein. The Riem U.S. Pat. No. 3,629,055 describes fire-retardant hardboard obtained by treatment with a hydrolyzable ammonium borate composition to provide hardboard containing 1.3 to 7% by weight of boron made by adding the boron compound to the wet mat of fibrous slurry in the production of hardboard. These prior art patents are directed to methods of introducing boric acid or inorganic borate salts into wood products for flame-proof and fire-retardant properties.

CROSS REFERENCE TO PENDING APPLICATION

This application discloses an improvement on the application of Gregory R. Moore et al, Ser. No. 588,687, filed June 20, 1975, now abandoned, which describes the production of fire-retardant wood products containing alumina trihydrate and boron oxide. The disclosure of the application is incorporated herein by reference.

BRIEF SUMMARY OF THE INVENTION

We have discovered that boric acid (or boron oxide) can be expeditiously introduced into wood products by first reacting boric acid with an organic alcohol to form, at least in part, a boric acid ester of the organic alcohol which may contain dissolved therein additional boric acid; coating the boric acid ester so produced onto surface of a wood product, preferably at elevated temperature in order to lower viscosity of the boric acid ester; allowing the boric acid ester to penetrate the wood surface for a minimum of five seconds, then wiping off the excess boric acid ester; repeating this operation until the appropriate amount of boric acid ester is applied to the wood product; heating the wood product thus produced to a temperature above the boiling point of water to evaporate any volatile alcohol or solvent which may be present and cause the boric acid ester to penetrate into the wood product; thereafter treating the wood product in a humidifier at elevated temperature and high relative humidity for a time sufficient to cause the wood product to absorb moisture and hydrolyze the boric acid ester to boric acid or boron oxide. In this way, it is possible to introduce boric acid or boron oxide ($B_2O_3$) into wood products to an extent of 3% to 20% by weight, or higher, thus reducing the flammability and smoke evolving properties of the wood product and rendering them fire-retardant and flame-retardant.

It is an object of this invention to provide an efficient method of introducing boron compounds into wood products.

It is another object to provide wood products containing boron compounds deposited therein.

A further object is to provide an effective method of producing borate ester compositions containing relatively high percentages of boron.

Another object is to provide procedures for impregnating wood products with boron compounds such as $B_2O_3$ or $H_3BO_3$ by applying to the surfaces of the wood liquid formulations of boric acid esters of organic alcohols.

These and other objects are apparent from and achieved in accordance with the following description of the invention.

GENERAL DESCRIPTION OF THE INVENTION

The wood products to which our invention can be applied include lumber, plywood, hardboard, particle board, luan board, fiber board and similar materials. Ordinarily the boric acid ester is applied to the finished wood product before any decorative or protective finish is applied thereto. The wood product may be natural lumber or man-made materials. Often it is advantageous to introduce boric acid or boron oxide into untreated wood products, but usually it is desirable to combine the boric acid treatment with other fire-proofing systems in order to provide wood products with maximum fire resistance.

In the practice of our invention it has been found that it is desirable to treat wood products which contain alumina, preferably in the form of alumina trihydrate, with boric acid esters to produce wood products which contain both alumina and boric acid. Such wood products are highly flame and smoke resistant and qualify for Class 1A ratings in Underwriters' Laboratory tests.

The borate ester used in this invention can be produced from boric acid and any of the higher organic alcohols such as butanol, pentanol, hexanol, nonanol, octanol, 2-methoxyethanol, 2-ethoxyethanol, 2-propoxyethanol, 2-butoxyethanol, ethylene glycol, propylene glycol, and its mono lower alkyl ethers, glycerol and its mono and di lower alkyl ethers, diethylene glycol, triethylene glycol, dipropylene glycol, tripropylene glycol, diethylene glycol monomethyl ether, diethylene glycol monoethyl ether, diethylene glycol monobutyl ether and similar diphatic alcohols. Boric acid can form esters with such alcohols in proportions of 1, 2 and 3 moles of alcohol per mole of boric acid or any combination between 1 and 3 moles of alcohol per mole of boric acid. Ordinarily these esters are produced by heating a mixture of the organic alcohol and boric acid to temperature in excess of 100° C. for a period of time varying from one-half to five hours. In general practice, it is desirable to add an azeotropic agent such as toluene, xylene or kerosene which aids in the removal of water produced as a byproduct of the esterification reaction and thus tends to force the reaction toward esterification. By appropriately selecting the quantities of alcohol and boric acid, the times and temperatures of the esterification reaction and the amount of water removed therefrom, it is possible to control the amount of esterification so that mono-, di- and/or triesters of boric acid can be obtained or mixtures thereof.

It is desirable that the boric acid ester contain as high a percentage of boron as possible so that the amount of boron introduced into the wood product can be kept to a maximum. Thus, mono esters of boric acid are desirable materials for impregnation of wood products. The amount of boron in the boric acid esters can be increased by dissolving boric acid in the borate esters and by this technique it is possible to increase the quantity of boron introduced into a wood product in each application. The boric acid esters have the general formulas $RO—B(OH)_2$ $(RO)_2BOH$ $(RO)_3B$ wherein R is an aliphatic organic radical containing 4–10 carbon atoms. With polyhydric alcohols such as ethylene glycol and propylene glycol, it is possible to form bis(triesters) of the following general type

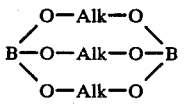

wherein Alk represents an alkylene radical containing 2, 3 or 4 carbon atoms. These esters are operative in this invention and are valuable as fire-retardant and flame-proofing agents because of their relatively high percentage of boron. As indicated above, the highest percentage of boron produces the most useful esters as fire-retardant and flame-proofing agents. It is, moreover, possible to further increase the boron content of the esters described above by dissolving or suspending boric acid therein.

In treating wood products to increase the fire retardant and flame-proof properties thereof, the boric acid ester in a fluid form is applied to the surface of the wood products with any of the usual coating equipment such as a direct roll coater, a wier pan or the like. The coating is applied in one or several passes so that an appropriate amount of boric acid ester is laid down on the surface of the wood. The amount of ester is selected so that the desired quantity of boric acid or boron oxide is formed in the wood product. In commercial operations the amount of boron in wood, calculated as boric acid, varies from 3 to about 20%, depending upon the special qualifications and properties desired in the wood product.

After the ester is applied to the surface of the wood, the wood product is passed through an oven or kiln at a temperature of 100° to 200° C. to remove any solvent or any excess alcohol and to cause the borate ester to penetrate into the fibers of the wood product. During this operation, there may occur esterification between the boric acid of the borate ester and the hydroxyl groups of the cellulose in the wood fibers. Finally, the wood product is treated with moist air or steam, usually at elevated temperature in the range of 50°–100° C. for a time sufficient to cause hydrolysis of a major part of the boric acid ester and to cuase the deposition of boric acid or boron oxide in the fibers of the wood product. During hydrolysis the alcohol is released and may evaporate at the temperature of the operation, either fully or partially. The result is a wood product containing boric acid or boron oxide deposited therein which exhibits flame-proof and fire-retardant properties. The hydrolysis of the borate esters in the wood product also occurs under ambient temperature and humidity conditions over a longer period of time.

If it is desired to treat the wood product with other impregnating agents such as petrolatum, tung oil and the like, it is possible to combine these impregnants with the boric acid ester prior to or during the coating operation and carry out the impregnation of the boric acid ester with these materials in one operation.

By the techniques of this invention, it is possible to obtain boric acid ester formulations containing as high as 48% boric acid equivalent, and it is thus possible to increase the boric acid or borate oxide content of wood to any desirable value. By treatment of alumina-containing wood products with boric ester formulations it is possible to increase and improve the fire-retardant and flame-resistant properties of wood by synergism.

This invention is further disclosed by means of the following examples which illustrate representative materials and procedures for introducing boric acid or boron oxide into wood products. It will be evident to those skilled in the prior art that various modifications can be made in operating conditions and materials without departing from the invention.

EXAMPLE 1

Fire-retardant borate resin was produced by the following procedure: 550 grams of boric acid, 650 grams of 2-methoxyethanol and 40 milliliters of toluene were placed in a reaction vessel fitted with an electric heating mantel; reflux condenser with a Barrett trap, thermometer and agitator. The contents of the vessel were heated to reflux (azeotropic distillation, commencing at about 115° C.) and water was drawn off through the trap. Over a period of about 2.5 hours the temperature of the reaction mixture rose to about 180° C. while water was removed continuously. The mixture was then allowed to cool to ambient temperature; it weighed 672 grams. The product was a resinous methoxyethyl borate in a waxy, semisolid state. When heated to 80°–100° C. it was of suitable viscosity for application to wood surfaces. It exhibited the following viscosity characteristics:

| Temperature (° C) | Zahn Cup No. | Time (seconds) | Viscosity (centipoise) |
|---|---|---|---|
| 90 | 5 | 40 | 800 |
| 95 | 5 | 32 | 625 |
| 100 | 5 | 23 | 425 |
| 120 | 3 | 31 | 238 |
| 130 | 3 | 18.5 | 110 |
| 140 | 3 | 14 | 85 |

EXAMPLE 2

A series of borate esters were produced by the procedure of Example 1 from four alcohols (2-butoxyethanol, 2-methoxyethanol, n-butanol and ethylene glycol) respectively, with the following results:

| Alcohol | 2-Butoxyethanol | 2-Methoxyethanol | n-Butanol | Ethylene glycol |
|---|---|---|---|---|
| Weight Boric Acid, g. | 410 | 185 | 185 | 185 |
| Wt. Alcohol, g. | 810 | 800 | 1000 | 308 |
| Toluene, ml. | 0 | 70 | 70 | 100 |
| Distillation Time, hrs. | 2 | 3 | 3 | — |
| Final Distn. Pot temp., ° C. | 250 | — | — | — |
| Wt. Aqueous Phase Removed, g. | 250 | 246 | 148 | 126 |
| Vol. Toluene Phase Removed ml. | — | 125 | 67 | 90 |
| Wt. Borate Ester, g. | 970 | 550 | 843 | 259 |
| Boric Acid Equivalent of Ester | | | | |

EXAMPLE 2-continued

A series of borate esters were produced by the procedure of Example 1 from four alcohols (2-butoxyethanol, 2-methoxyethanol, n-butanol and ethylene glycol) respectively, with the following results:

| Alcohol | 2-Butoxyethanol | 2-Methoxyethanol | n-Butanol | Ethylene glycol |
|---|---|---|---|---|
| Calc. by weight, % | 42 | 34 | 22 | 42 |
| Analyzed % | 41.3 | 33.1 | 21.5 | — |

The ethylene glycol borate was extremely viscous and was diluted with 185 grams of 2-methoxyethanol for application to wood surfaces.

EXAMPLE 3

Hardboard panels, 4 feet × 8 feet, one-quarter inch thick, containing varying amounts of alumina trihydrate between 45% and 60%, were preheated to 120°–135° C. Then the borate ester resin of Example 1, preheated to 88°–104° C. (600–800 centipoise viscosity), was applied to the surface of the hardboard panels by means of a flow coater at a speed of 75–80 feet per minute. The borate resin was allowed to penetrate the board surface for a minimum of five seconds. Then the excess resin was wiped off by passing the panels through a direct roll coater. Each panel received three such coats of borate resin with a minimum total penetration time of 15 seconds. As each panel passed through the direct roll coater, a thin coat of borate resin was applied to the back side.

Following the resin application, the panels were passed through a heat treating kiln for 1.5–2 hours at 150°–165° C. to remove any excess solvent and cause the resin to penetrate into the board. After the heat-treating step, the panels were processed through a humidifier at 88°–94° C. at 90% relative humidity for 4–5 hours to humidify the panels to about 4.5–6% moisture content. Panels processed in the above-described manner were analyzed for boric acid content which ranged from 5.5–8%. These panels were fire rated as Class I(A) when subjected to the E-84 flame test of the Underwriters Laboratory. They exhibited the following properties:

-continued

| Physical Tests | Low | Average | High |
|---|---|---|---|
| Caliper | .211 inch | .236 inch | .262 inch |
| Specific Gravity | 1.03 | 1.13 | 1.18 |
| MOR | 1430 psi | 2375 psi | 4300 psi |
| Bond (internal) | 35 psi | 80 psi | 190 psi |
| 24-Hr. Water Absorp. | 8.4% | 10.0% | 13.4% |
| 24-Hr. Swell | 6.3% | 8.4% | 10.6% |
| % Moisture | 1.0% | 1.9% | 2.4% |

Chemical Analysis

| Sample No. | % Alumina | Boric Acid |
|---|---|---|
| 14–6 | 68.1 | 7.81 |
| 25–6 | 52.6 | 7.61 |
| 38–12 | 58.2 | 7.81 |

We claim:

1. Method of impregnating wood with boric acid or boron oxide, which comprises applying thereto a boric acid ester of an organic alcohol, heating the wood to cause the ester to penetrate into the wood, and hydrolyzing said ester to deposit boric acid or boron oxide therein.

2. Method of claim 1 wherein said boric acid ester is an ester of an alcohol containing at least four carbon atoms.

3. Method of claim 2 wherein said alcohol is an alkoxyalkanol.

4. Method of claim 3 wherein said alcohol is methoxyethanol.

5. Method of claim 3 wherein said alcohol is butoxyethanol.

6. Method of claim 1 wherein said boric acid ester is formed by heating boric acid and an organic alcohol together with an azeotropic solvent, whereby water is removed from the reaction mixture by azeotropic distillation.

* * * * *

UNITED STATES PATENT OFFICE

CERTIFICATE OF CORRECTION

Patent No. 4,076,871 Dated February 28, 1978

Inventor(s) Buddy M. Short, et al.

It is certified that error appears in the above-identified patent and that said Letters Patent are hereby corrected as shown below:

Directly under the title the residence of both inventors is printed as "Michigan" and should be -- Mississippi --

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*